United States Patent [19]

Bunce et al.

[11] Patent Number: 4,924,048

[45] Date of Patent: May 8, 1990

[54] TRAY FOR USE IN MICROWAVE OVENS WITH HEAT SEALED COVER AND INNER LID

[75] Inventors: Martin C. Bunce; David W. Helps, both of London; Leonard A. Jenkins, Southmoor; Adrian C. Noke, Wantage, all of England

[73] Assignee: CMB Packaging (UK) Limited, Worcester, United Kingdom

[21] Appl. No.: 336,061

[22] Filed: Apr. 11, 1989

[30] Foreign Application Priority Data

Apr. 11, 1988 [GB] United Kingdom ..... 8808458

[51] Int. Cl.[5] ..... H05B 6/80; B65D 81/34

[52] U.S. Cl. ..... 219/10.55 E; 426/107; 426/234; 426/243; 99/DIG. 14; 220/361; 229/903; 219/10.55 R

[58] Field of Search ..... 219/10.55 E, 10.55 F, 219/10.55 R; 426/107, 109, 112, 113, 241, 243, 234; 99/DIG. 14; 220/257, 361, 359, DIG. 27; 229/902, 903, 906, 905

[56] References Cited

U.S. PATENT DOCUMENTS

| | | | |
|---|---|---|---|
| 2,880,859 | 4/1959 | Tupper | 220/359 |
| 3,054,679 | 9/1962 | Bradford | 220/359 |
| 3,245,338 | 4/1966 | Korr | 426/107 |
| 3,597,238 | 8/1971 | Scharre | 426/107 |
| 3,997,677 | 12/1976 | Hirsch et al. | 426/113 |
| 4,210,674 | 7/1980 | Mitchell | 219/10.55 E |
| 4,327,136 | 4/1982 | Thompson et al. | 219/10.55 E |
| 4,574,174 | 3/1986 | McGonigle | 219/10.55 E |
| 4,590,078 | 5/1986 | Umina | 426/113 |
| 4,592,914 | 6/1986 | Kuchenbecker | 426/107 |
| 4,661,671 | 4/1987 | Maroszek | 219/10.55 E |

FOREIGN PATENT DOCUMENTS 1530605 5/1975 United Kingdom .

*Primary Examiner*—Philip H. Leung

*Attorney, Agent, or Firm*—Burns, Doane, Swecker & Mathis

[57] ABSTRACT

A tray-type food container for food which is to be heated or re-heated in the container comprises both a flat outer lid heat-sealed to a horizontal flange on the tray and a perforated inner lid of substantially rigid and preferably transparent material which is supported on a step in the wall of the tray and is shaped so as to extend above the level of the step and to provide finger holes whereby it may be grasped and removed after the outer lid has been removed. The inner lid may support the outer lid flush with the flange. The flange may have a peripheral groove to form a guide for a knife for removal of the outer lid. The flange may also carry heating instructions in a machine readable code. A vending machine comprising a microwave oven may be provided with means for selecting a container from a number of stacks and with means for reading the coded heating instructions and regulating the energy supply to the microwave oven accordingly.

8 Claims, 4 Drawing Sheets

TRAY FOR USE IN MICROWAVE OVENS WITH HEAT SEALED COVER AND INNER LID

FIELD OF THE INVENTION

This invention relates to food containers and more particularly to containers for foods which are to be heated or re-heated in the container. In one particular form, it is especially concerned with food containers for use in conjunction with a vending machine incorporating a microwave heating oven for dispensing selected hot foods in the container.

BACKGROUND TO THE INVENTION

Food containers are known comprising a tray with a horizontal flange extending outwardly from an upwardly extending wall around its periphery, and a flat outer lid heat-sealed to the horizontal flange all around its periphery. The outer lid is normally removed before heating the contents to allow escape of steam or expansion of gases. With such a container, once the outer lid has been removed the contents are fully exposed to the atmosphere and, if hot, will cool rapidly as well as being liable to be spilt or splashed out of the tray when the latter is being handled prior to consumption of the contents.

SUMMARY OF THE INVENTION

According to the present invention, in a food container comprising a tray with a horizontal flange extending outwardly from an upwardly extending wall around its periphery, and an outer lid heat-sealed to the horizontal flange all around its periphery, a perforated inner lid is supported within the container so as to permit venting when the outer lid has been removed and the food is heated in the container. Preferably the perforated inner lid is of substantially rigid material, is supported on a step in the wall and is shaped so as to extend above the level of the step and to provide finger holds whereby it may be grasped and removed after the outer lid has been removed. The inner lid can be left in position during heating of the contents of the container, because the perforations allow for escape of steam or expansion of gases.

It helps to prevent spilling or splashing of the food out of the container and delays cooling of the hot food, but it can readily be removed to allow consumption of the food, e.g by use of the finger holds mentioned above.

Preferably the inner lid extends above the level of the step to such an extent as to support the outer lid flush with the horizontal flange. For example, the inner lid may have a peripheral flange for seating on the step in the wall, an inclined portion extending upwardly from the peripheral flange and a flat top portion supporting the outer lid. Indented formations may be provided in the inclined portion on opposite sides of the inner lid to form the finger holds.

Preferably the inner lid is transparent, so that the contents of the container can be seen when the outer lid has been removed.

The horizontal flange may advantageously be extended at two opposite locations to form a pair of handles for carrying the container.

The horizontal flange is preferably formed with a groove extending around its upper surface to form a guide for a knife for removal of the portion of the outer lid which lies within the area bounded by the groove.

The tray is preferably formed of a laminate of a metal and a polymer, or of a laminate of different polymers chosen to provide the laminate with a high barrier to oxygen permeation.

Specific embodiments of the invention will now be described in more detail by way of example and with reference to the accompanying drawings in which:

DESCRIPTION OF THE PREFERRED EMBODIMENTS

Figure 1:
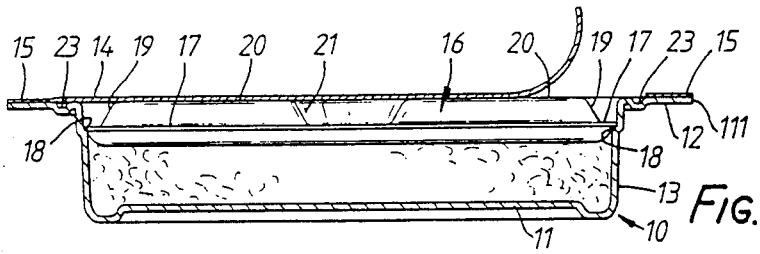
FIG. 1 is a vertical cross section through a food container in accordance with the invention.
Figure 2:
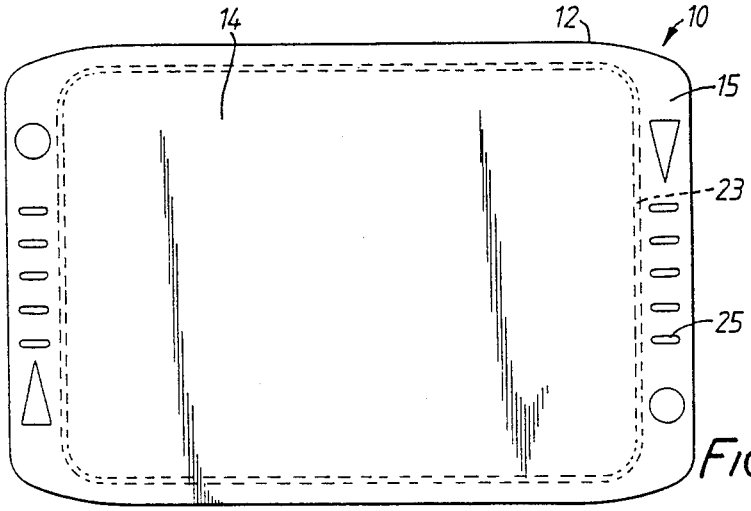
FIG. 2 is a plan view of the food container of FIG. 1.
Figure 3:
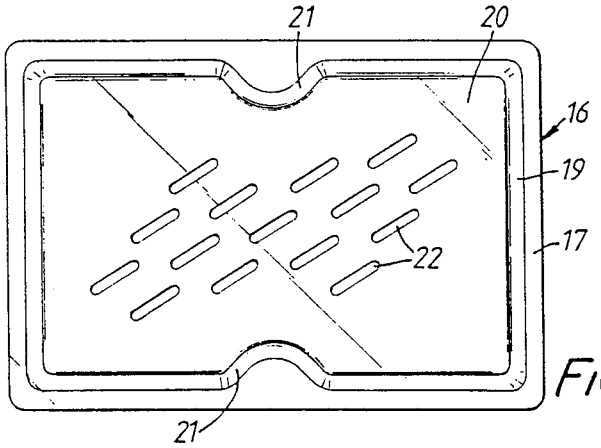
FIG. 3 is a plan view of the inner lid.
Figure 4:
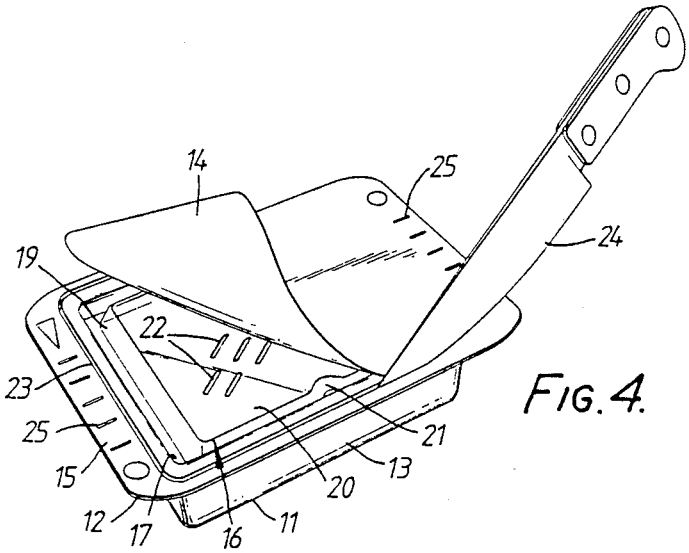
FIG. 4 is a perspective view from above of the container of FIGS. 1 and 2, showing removal of the outer lid.
Figure 5:
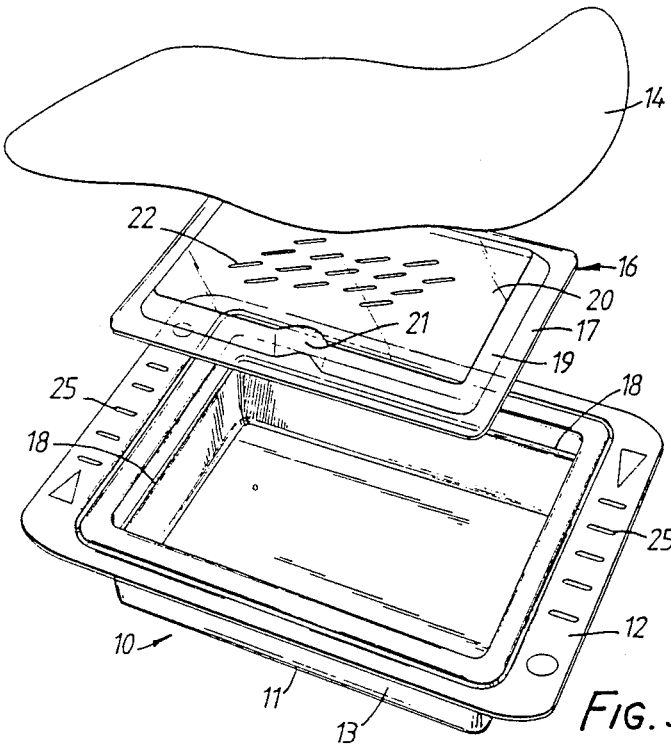
FIG. 5 is an exploded perspective view of the container.

As illustrated in FIGS. 1 to 5, a food container 10 intended for containing food which is to be heated or reheated in the container, e.g. in a vending machine incorporating a microwave oven, comprises a substantially rectangular tray 11 with a horizontal flange 12 extending outwardly from an upwardly extending wall 13 around its periphery and a flat outer lid 14 heat-sealed to the horizontal flange 12 in a marginal zone 15, all around the periphery of the flange. At the ends 111 of the rectangular tray 11, the flange 12 is extended so as to be wider than it is along the sides of the tray in order to provide a convenient pair of handles for carrying the tray. The tray 11 is preferably made of a laminate of a metal and polymer, e.g. as described in our co-pending British Patent Application No. 8724237.

The container 10 further comprises an inner lid 16 (shown in plan view in FIG. 3) of substantially rigid material, e.g. of a transparent polymeric material. The inner lid 16 has a peripheral flange 17 which is seated on an inward step 18 in the wall 13 of the tray. The inner lid 16 also has an inclined portion 19 extending upwardly from the peripheral flange 17 and a flat top portion 20 which supports the outer lid 14 flush with the horizontal flange 12 of the tray. The inclined portion 19 is formed with indented formations 21 on opposite sides of the inner lid to form finger holds whereby the inner lid 16 may be grasped and removed after the outer lid 14 has been removed. The flat top portion 20 of the inner lid is formed with perforations 22 to allow escape of steam or expanding gases during heating of the contents of the container.

The horizontal flange 12 is formed with a groove 23 extending around its upper surface to form a guide for a knife (shown at 24 in FIG. 4) for removal of that portion of the outer lid 14 which lies inside the marginal zone 15 and the groove 23.

Figure 8:
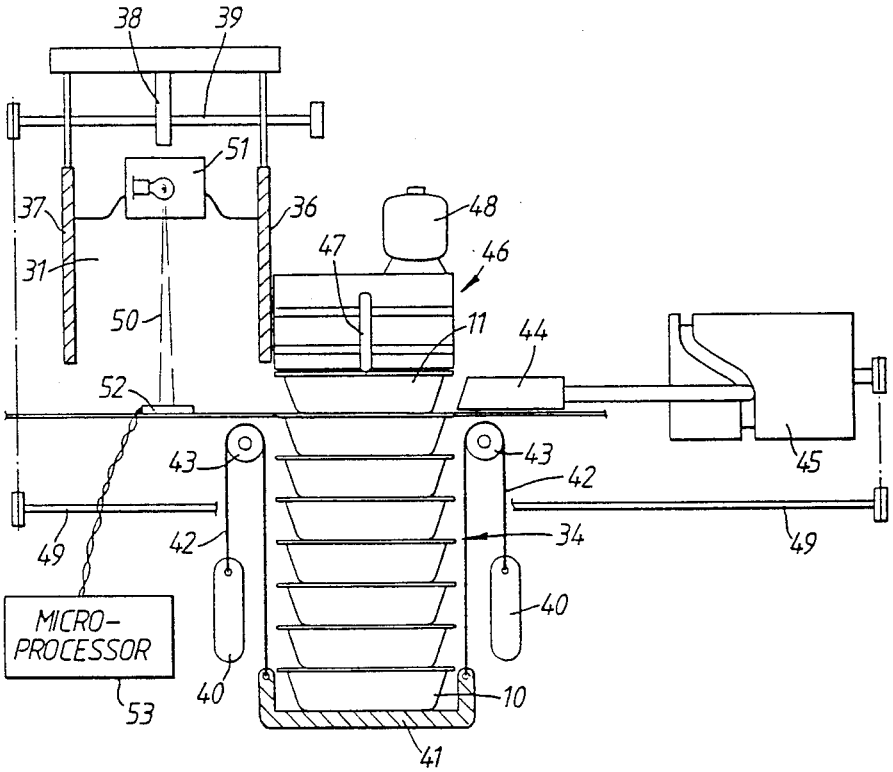
FIG. 8 is a diagrammatic sectional view of the loading station of the machine of FIGS. 6 and 7.

When the food container 10 is intended for microwave heating or re-heating of its contents, especially in a vending machine incorporating a microwave oven, heating instructions in a machine readable code are provided on the outer lid 14 or on the tray 11, located so that they can be read by a reading head such as that shown at 52 in FIG. 8, arranged to supply an appropriate control signal to the microwave oven. The instructions may, for example, comprise apertures in the flange 12, as indicated diagrammatically at 25, for use with an optical reading head comprising a light source and a plurality of photo cells arranged to receive light from the source through the apertures. In that case, the outer lid will be transparent or will be formed with apertures corresponding to those in the flange 12.

Alternatively, the heating instructions may comprise blind recesses or depressions in the flange 12, for cooperating with an electromechanical reading head (not shown) comprising an array of resiliently mounted pins coupled to micro-switches.

Figure 6:
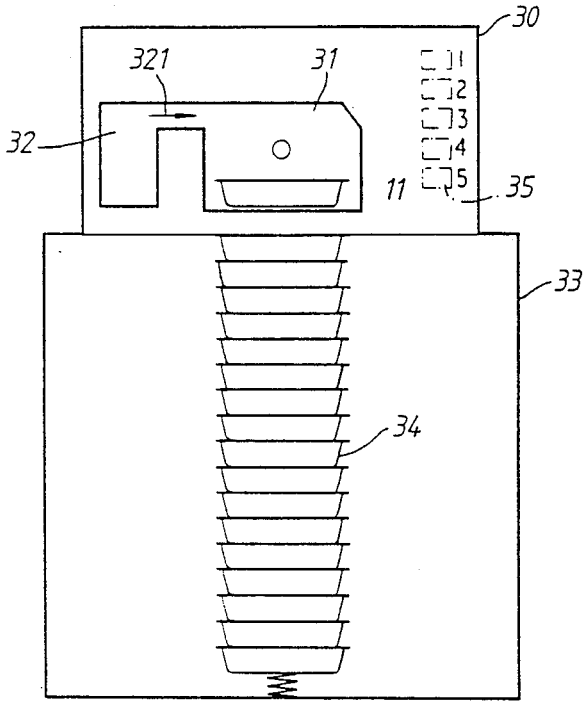
FIG. 6 is a diagrammatic elevation of a vending machine for use with containers in accordance with the invention.
Figure 7:
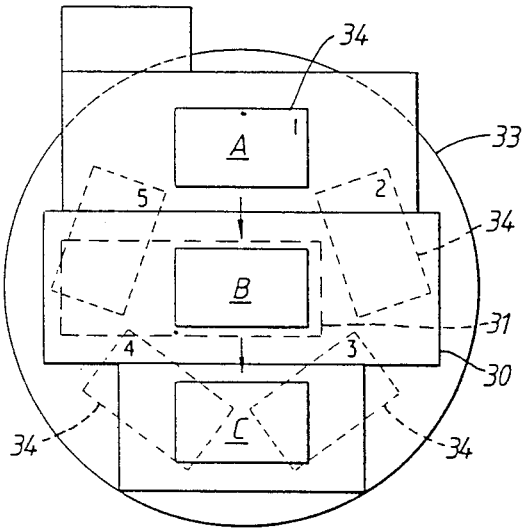
FIG. 7 is a diagrammatic plan view of the machine of FIG. 6.

A vending machine suitable for using containers as described above is diagrammatically illustrated in FIGS. 6 to 8. It comprises an oven enclosure 30 enclosing a microwave oven 31 energised by a magnetron 32 and mounted on top of a magazine 33 containing a number of stacks 34 of containers 10 as described above, all being of a standard size and shape and having inner lids 16 and outer lids 14. As shown in FIG. 7, the magazine 33 may be in the form of a rotary carousel containing, for example, five stacks 34 of containers 10 containing five different varieties of food. Five selector buttons 35 are accordingly provided on the oven enclosure 30 and connected to a drive mechanism such that on pressing one of the buttons 35 the corresponding stack 34 is brought to a position for introducing the topmost tray into the oven 31 (position A as shown in FIG. 7).

The microwave oven 31 is so dimensioned that its horizontal dimensions exceed those of the tray 11 by substantially 10 mm, so as to allow a gap of 5 mm between the flange 12 and the oven walls to prevent arcing while the vertical dimension is chosen to ensure that a true resonant cavity is produced for microwave radiation of the wavelength used. The radiation is introduced through a waveguide 321 into the top of the tray 11 in the oven 31. It is found that this dimensioning and arrangement of the microwave oven results in particularly rapid and efficient heating of the food.

FIG. 8 illustrates diagrammatically an arrangement for introducing the tray 11 of the uppermost container 10 into the microwave oven 31 (position B in FIG. 7). In this arrangement, the microwave oven 31 has vertically movable entry and exit doors 36,37 whose movement is controlled by a lift cam 38 mounted on a rotary shaft 39. The stack 34 of containers 10 is constantly urged upwardly, e.g. by a pair of weights 40 attached to a cradle 41 by wires 42 passing over pulleys 43. A horizontally movable pusher element 44 normally lies over the top of the uppermost container 10, but when a button 35 has been pressed the pusher 44 is withdrawn by rotation of a desmodromic cam 45 to the position shown in FIG. 8 which allows the uppermost container 10 to rise into contact with a cutting mechanism 46 for removal of the outer lid 14. The cutting mechanism 46 may consist of, for example, a series of vertical knives 47 (only one of which is seen in FIG. 8) which are driven around a rectangular course by a motor 48 to sever the outer lid 14 on a line coinciding with the peripheral groove 23 in the flange 12. When the outer lid 14 has been severed, the pusher 44 is urged by the cam 45 to the left as seen in FIG. 8. At the same time, through a mechanical connection diagrammatically indicated as a shaft 49, the lift cam 38 lifts the entry and exit doors 36 and 37 so that the tray 11 can be pushed into the oven 31. As the tray 11 reaches the appropriate heating position in the oven 31, an optical reading head comes into operation as follows: A beam of light 50 from a lamp 51 impinges on the flange 12 and a sensor 52 picks up the heating instructions from the coded information 25 and passes them to a microprocessor 53 which then determines the appropriate supply of energy to the microwave oven 31, and closes the doors 36,37.

On completion of the appropriate degree of heating, as determined by the microprocessor 53, the entry and exit doors 36,37 are again raised. The customer can then reach into the oven and remove the container 10, or a separate removal mechanism may be provided.

We claim:

1. A food container formed of a material suitable for use in microwave ovens comprising:

an upstanding peripheral wall;

a horizontal flange extending outwardly from said wall around its periphery;

an outer lid heat-sealed to the horizontal flange around its periphery;

a step formed in said peripheral wall; and an inner lid formed of a substantially rigid material supported by said step and comprising an upwardly extending peripheral wall and a substantially flat top portion perforated so as to permit venting when the outer lid has been removed and food is heated in the tray;

said upwardly extending peripheral wall extending to a sufficient height above said step so that said top portion of the inner lid serves to support the outer lid; and said upwardly extending peripheral wall being shaped to provide indented portions which act as fingerholds whereby the inner lid may be grasped and removed after the outer lid has been removed.

2. A food container according to claim 1 wherein said upwardly extending peripheral wall of the inner lid extends above the level of the step to such an extent that said top portion supports the outer lid flush with the horizontal flange.

3. A food container according to claim 1, wherein the inner lid has a peripheral flange for seating on the step, and wherein the upwardly extending peripheral wall of the inner lid is inclined upwardly from the peripheral flange.

4. A food container according to claim 1, wherein the inner lid is transparent.

5. A food container according to claim 1, wherein the horizontal flange is extended to two opposite locations to form a pair of handles for carrying the container.

6. A food container according to claim 1 wherein the horizontal flange on the tray is formed with a groove extending around its upper surface to form a guide for a knife for removal of the portion of the outer lid which lies inside the area bounded by the groove.

7. A food container according to claim 1, wherein the tray is formed of a laminate of a metal and a polymer.

8. A food container according to claim 1 wherein the tray is formed of a laminate of different polymers chosen to provide the laminate with a high barrier to oxygen permeation.

* * * * *